US006830402B2

(12) United States Patent
Sunatori

(10) Patent No.: US 6,830,402 B2
(45) Date of Patent: Dec. 14, 2004

(54) AUTO-RETRACTABLE PEN MECHANISM WITH A CUSHION EFFECT

(76) Inventor: Go Simon Sunatori, 65, des Paulines, Gatineau, QC (CA), J9A 1Z4

( * ) Notice: Subject to any disclaimer, the term of this patent is extended or adjusted under 35 U.S.C. 154(b) by 0 days.

(21) Appl. No.: 10/818,019

(22) Filed: Apr. 6, 2004

(65) Prior Publication Data

US 2004/0228671 A1 Nov. 18, 2004

(30) Foreign Application Priority Data

May 17, 2003 (CA) ..... 2429153

(51) Int. Cl.[7] ..... B43K 5/16; B43K 23/02
(52) U.S. Cl. ..... 401/100; 401/131
(58) Field of Search ..... 401/48, 99, 100, 401/103, 131

(56) References Cited

U.S. PATENT DOCUMENTS 2,870,741 A * 1/1959 Kersten ..... 401/100
3,063,419 A * 11/1962 Parker ..... 401/100
4,176,979 A * 12/1979 Saida ..... 401/100
6,394,677 B2 5/2002 Wang

* cited by examiner

*Primary Examiner*—David J. Walczak

(57) ABSTRACT

A retractable pen comprises a pen and a cap. The pen comprises a hollow case, an ink cartridge, a mechanical spring and a mobile magnetic element. The cap comprises a cap body and a stationary permanent magnet. The pen is capable of attaching to the cap by the magnetic attraction force in a single-hand operation when a user places the mobile magnetic element of the pen in proximity to the stationary permanent magnet of the cap. The writing tip of the ink cartridge of the pen retracts into the hollow case of the pen when an upward magnetic attraction force is greater than a downward mechanical expansion force. This invention relates to pens, and the principal use of the invention is for operating a pen with a single hand.

16 Claims, 5 Drawing Sheets

AUTO-RETRACTABLE PEN MECHANISM WITH A CUSHION EFFECT

BACKGROUND OF THE INVENTION

This invention relates to pens, more particularly to a retractable pen.

There are many instances where it would be desirable to be able to provide a retractable pen with a mechanism to allow a user to magnetically attach a pen to a cap in a single-hand operation, and to simultaneously retract the writing tip.

A number of patents disclose retractable pens.

U.S. Pat. No. 6,394,677 discloses "Hanging pen and cord thereof". This prior art pen has a pen cap, and a penholder. The pen cap has a blocking cover with a loop cord for carrying and an opening at the other end. The penholder provides a center stick therein with a writing head of the center stick extending outwardly from a conical part at an end of the penholder. A magnetic ring is fixed in the pen cap. The conical part is made of magnet inducing material. The pen cap engages the penholder by way of the magnetic ring attracting the conical part when the conical part is inserted into the pen cap from the open end.

These prior art arrangements do not provide a retractable pen with a mechanism to allow a user to magnetically attach a pen to a cap in a single-hand operation. In addition, prior art retractable pens do not simultaneously retract the writing tip when the pen is attached to the cap. Moreover, prior art retractable pens do not provide a cushion effect to the writing tip.

BRIEF SUMMARY OF THE INVENTION

It is a primary object of the invention to provide a retractable pen in which a pen magnetically attaches to a cap in a single-hand operation by the user.

It is another object of the invention to provide a retractable pen which simultaneously retract the writing tip when the pen is attached to the cap.

It is another object of the invention to provide a retractable pen in which the pen stays upside up and downside down when attached to the cap.

It is another object of the invention to provide a retractable pen which has a cushion effect.

It is another object of the invention to provide a retractable pen which has a loop-shaped cord to be worn by the user around his/her neck.

A retractable pen comprises a pen and a cap. The pen comprises a hollow case, an ink cartridge, a mechanical spring and a mobile magnetic element. The cap comprises a cap body and a stationary permanent magnet. The pen is capable of attaching to the cap by the magnetic attraction force in a single-hand operation when a user places the mobile magnetic element of the pen in proximity to the stationary permanent magnet of the cap. The writing tip of the ink cartridge of the pen retracts into the hollow case of the pen when an upward magnetic attraction force is greater than a downward mechanical expansion force.

BRIEF DESCRIPTION OF THE SEVERAL VIEWS OF THE DRAWING

In drawings which illustrate embodiments of the invention.

DETAILED DESCRIPTION OF THE INVENTION

Figure 1:
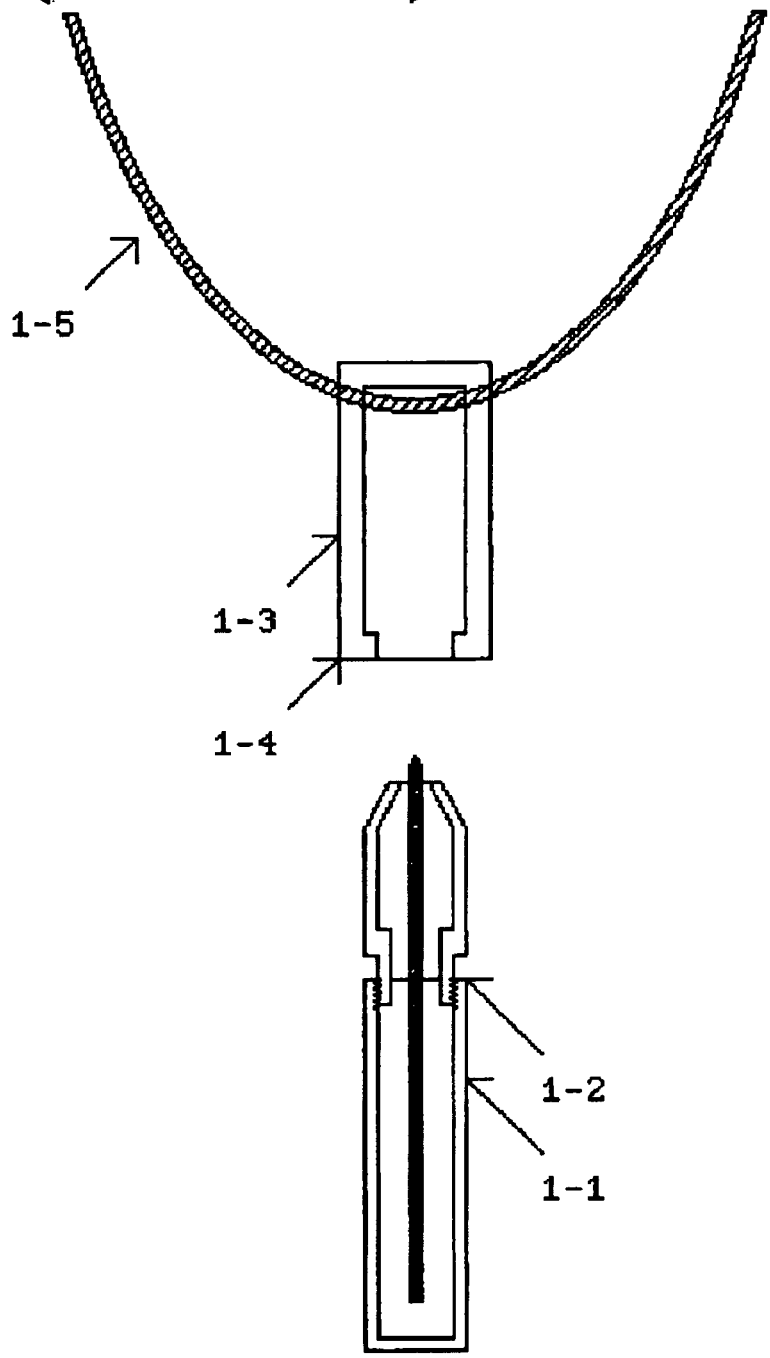
Figure 1 (Prior Art)
FIG. 1 marked "Prior Art" is a sectional view of a conventional wearable pen in a detached position.

A conventional wearable pen shown in FIG. 1 marked "Prior Art" in a detached position comprises a pen and a neck cord.

The pen comprises a pen body 1-1. The pen body 1-1 of the pen has a closed end, a middle portion and a writing tip. The middle portion of the pen body 1-1 forms a female part 1-2.

The neck cord comprises a loop-shaped cord 1-5 and a cap body 1-3. The cap body 1-3 has a top portion and an open bottom portion. The top portion of the cap body 1-3 is securely attached to the loop-shaped cord 1-5. The open bottom portion of the cap body 1-3 forms a male part 1-4 for providing a mechanical engagement force.

The female part 1-2 of the pen is capable of engaging with the male part 1-4 of the neck cord by the mechanical engagement force when a user inserts the pen into the cap body 1-3 of the neck cord. The female part 1-2 of the pen is capable of detaching from the male part 1-4 of the neck cord when a user applies a force greater than the mechanical engagement force between the female part 1-2 of the pen and the male part 1-4 of the neck cord.

Figure 2:
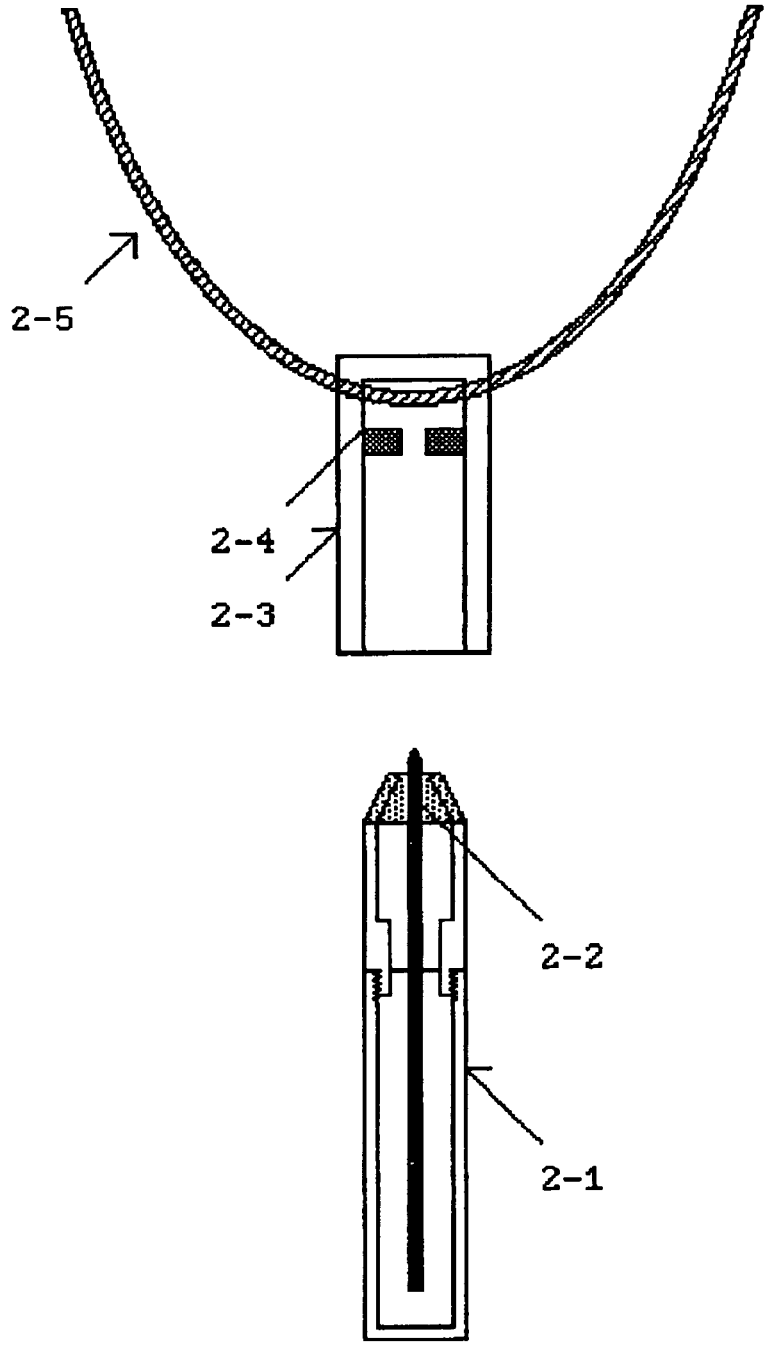
Figure 2 (Prior Art)
FIG. 2 marked "Prior Art" is a sectional view of another conventional wearable pen in a detached position.

Another conventional wearable pen shown in FIG. 2 marked "Prior Art" in a detached position comprises a pen and a neck cord.

The pen comprises a pen body 2-1. The pen body 2-1 of the pen has a closed end, a conical portion and a writing tip. The conical portion of the pen body 2-1 comprises a ferromagnetic element 2-2.

The neck cord comprises a loop-shaped cord 2-5, a cap body 2-3, and a permanent magnet 2-4 for providing a magnetic attraction force. The cap body 2-3 has a top portion and an open bottom portion. The top portion of the cap body 2-3 is securely attached to the loop-shaped cord 2-5. The permanent magnet 2-4 is securely mounted inside the cap body 2-3.

The ferromagnetic element 2-2 of the pen is capable of attaching to the permanent magnet 2-4 of the neck cord by the magnetic attraction force when a user inserts the pen into the cap body 2-3 of the neck cord. The ferromagnetic element 2-2 of the pen is capable of detaching from the permanent magnet 2-4 of the neck cord when a user applies a force greater than the magnetic attraction force between the ferromagnetic element 2-2 of the pen and the permanent magnet 2-4 of the neck cord.

These prior art pens do not provide a wearable pen in which a pen attaches to a neck cord in a single-hand operation because of the need to align the pen for insertion into the cap body. In addition, because the conventional wearable pen is hung upside down, it is necessary that the prior art pen be a so-called Space Pen (Trade Mark), comprising a hermetically-sealed ink cartridge filled with pressurised gas in order to avoid ink leakage.

Figure 3:
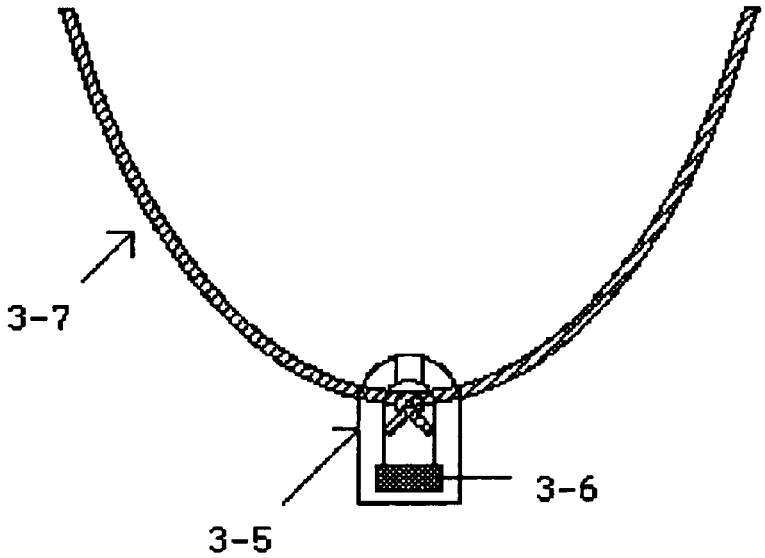
FIG. 3 is a sectional view of one embodiment of a retractable pen in a detached position according to the invention.
Figure 3:
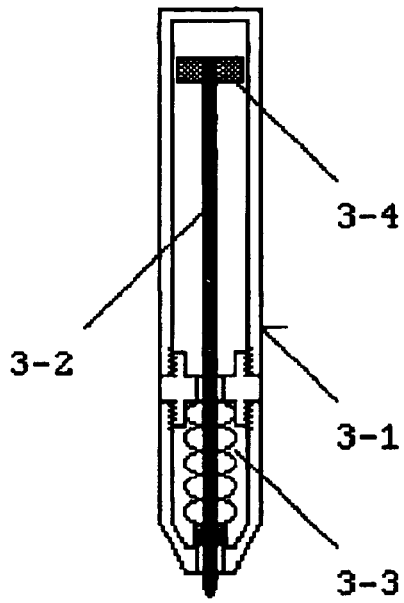
Figure 4:
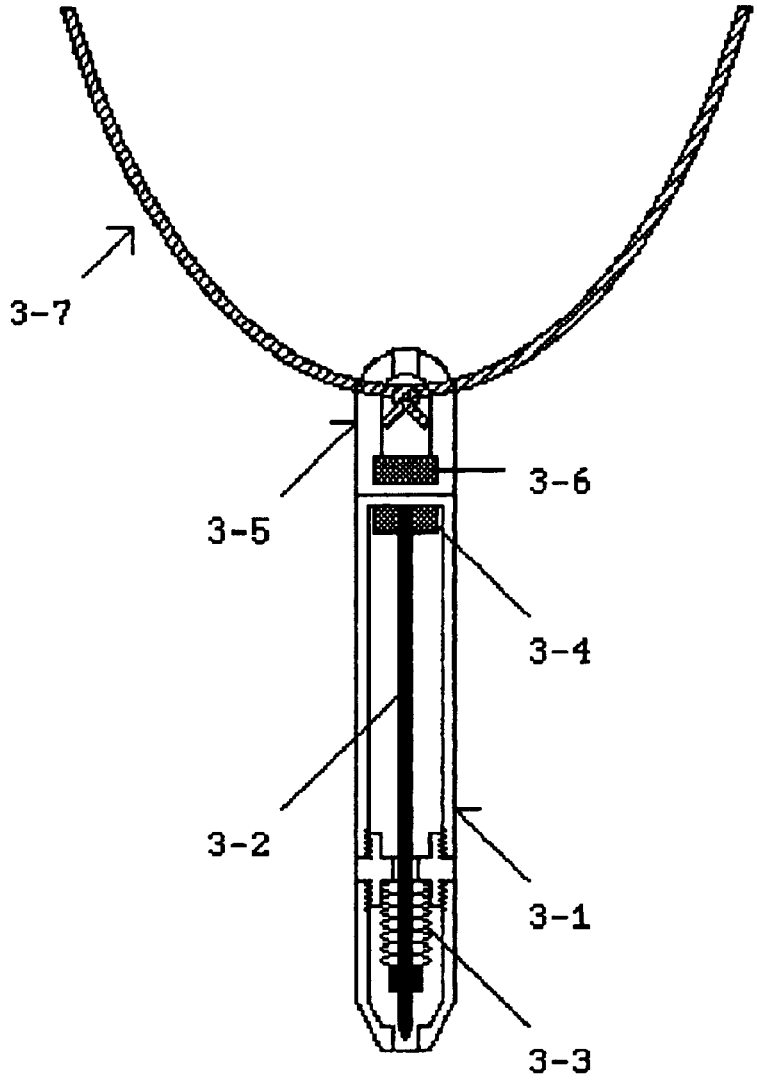
FIG. 4 is a sectional view of the invention in an attached position.
Figure 5:
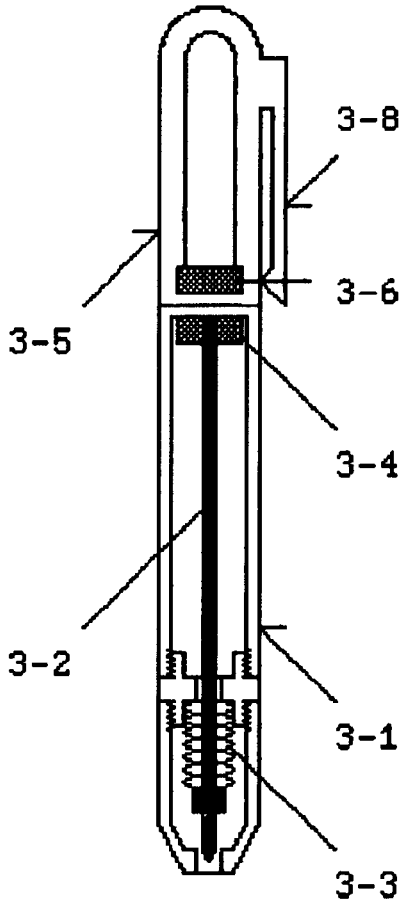
FIG. 5 is a sectional view of another embodiment of a retractable pen in an attached position according to the invention.

In one embodiment of the invention shown in FIG. 3 in a detached extended position, FIG. 4 in an attached retracted position and FIG. 5 in an attached retracted position, a retractable pen comprises a pen and a cap.

The pen comprises a hollow case 3-1, an ink cartridge 3-2, a mechanical spring 3-3 for downwardly biasing the ink cartridge 3-2, and a mobile magnetic element 3-4.

The hollow case 3-1 of the pen has a closed end, a narrow middle portion and an open conical end.

The ink cartridge 3-2 of the pen has a top end, a fat portion and a writing tip. The ink cartridge 3-2 is movably mounted inside the hollow case 3-1. The writing tip of the ink cartridge 3-2 is capable of penetrating through the open conical end of the hollow case 3-1.

The mechanical spring 3-3 of the pen is concentrically mounted around the ink cartridge 3-2 between the narrow middle portion of the hollow case 3-1 and the fat portion of the ink cartridge 3-2.

The mobile magnetic element 3-4 of the pen is securely attached to the top end of the ink cartridge 3-2.

The cap comprises a cap body 3-5 and a stationary permanent magnet 3-6 for providing a magnetic attraction force.

The cap body 3-5 of the cap has a top end and a bottom end.

The stationary permanent magnet 3-6 of the cap is securely attached to the bottom end of the cap body 3-5.

The pen is capable of attaching to the cap by the magnetic attraction force in a single-hand operation when a user places the mobile magnetic element 3-4 of the pen in proximity to the stationary permanent magnet 3-6 of the cap. The writing tip of the ink cartridge 3-2 of the pen retracts into the hollow case 3-1 of the pen when an upward magnetic attraction force between the mobile magnetic element 3-4 of the pen and the stationary permanent magnet 3-6 of the cap is greater than a downward mechanical expansion force by the mechanical spring 3-3 of the pen.

The downward mechanical expansion force by the mechanical spring 3-3 of the pen may provide a cushion effect to the writing tip of the ink cartridge 3-2 of the pen.

The retractable pen may further comprise a loop-shaped cord 3-7 securely attached to the top end of the cap body 3-5 of the cap.

The retractable pen may further comprise a pocket clip 3-8 securely attached to the top end of the cap body 3-5 of the cap.

The hollow case 3-1 of the pen may be cylindrical.

The mobile magnetic element 3-4 of the pen may be disc-shaped or ring-shaped.

The mobile magnetic element 3-4 of the pen may be made of a rare-earth permanent magnet. Alternatively, the mobile magnetic element 3-4 of the pen may be made of a ferromagnetic material.

The cap body 3-5 of the cap may be cylindrical.

The stationary permanent magnet 3-6 of the cap may be disc-shaped or ring-shaped.

The stationary permanent magnet 3-6 of the cap may be made of a rare-earth permanent magnet.

The stationary permanent magnet 3-6 of the cap may be exposed.

The ink cartridge 3-2 of the pen may be a ball-point pen, or a gel-ink pen.

The magnetic attraction force between the mobile magnetic element 3-4 of the pen and the stationary permanent magnet 3-6 of the cap provides self-alignment between the hollow case 3-1 of the pen and the cap body 3-5 of the cap.

What is claimed is:

1. A retractable pen comprising:

a pen comprising:

a hollow case having a closed end, a narrow middle portion and an open conical end;

an ink cartridge having a top end, a fat portion and a writing tip, the ink cartridge movably mounted inside the hollow case, the writing tip of the ink cartridge being capable of penetrating through the open conical end of the hollow case;

a mechanical spring for downwardly biasing the ink cartridge, the mechanical spring concentrically mounted around the ink cartridge between the narrow middle portion of the hollow case and the fat portion of the ink cartridge; and a mobile magnetic element securely attached to the top end of the ink cartridge; and a cap comprising:

a cap body having a top end and a bottom end; and a stationary permanent magnet for providing a magnetic attraction force, the stationary permanent magnet securely attached to the bottom end of the cap body;

the pen being capable of attaching to the cap by the magnetic attraction force in a single-hand operation when a user places the mobile magnetic element of the pen in proximity to the stationary permanent magnet of the cap, the writing tip of the ink cartridge of the pen retracting into the hollow case of the pen when an upward magnetic attraction force between the mobile magnetic element of the pen and the stationary permanent magnet of the cap is greater than a downward mechanical expansion force by the mechanical spring of the pen.

2. The retractable pen as defined in claim 1, in which the downward mechanical expansion force by the mechanical spring of the pen provides a cushion effect to the writing tip of the ink cartridge of the pen.

3. The retractable pen as defined in claim 1, further comprising:

a loop-shaped cord securely attached to the top end of the cap body of the cap.

4. The retractable pen as defined in claim 1, further comprising:

a pocket clip securely attached to the top end of the cap body of the cap.

5. The retractable pen as defined in claim 1, in which the hollow case of the pen is cylindrical.

6. The retractable pen as defined in claim 1, in which the mobile magnetic element of the pen is disc-shaped.

7. The retractable pen as defined in claim 1, in which the mobile magnetic element of the pen is ring-shaped.

8. The retractable pen as defined in claim 1, in which the mobile magnetic element of the pen is made of a rare-earth permanent magnet.

9. The retractable pen as defined in claim 1, in which the mobile magnetic element of the pen is made of a ferromagnetic material.

10. The retractable pen as defined in claim 1, in which the cap body of the cap is cylindrical.

11. The retractable pen as defined in claim 1, in which the stationary permanent magnet of the cap is disc-shaped.

12. The retractable pen as defined in claim 1, in which the stationary permanent magnet of the cap is ring-shaped.

13. The retractable pen as defined in claim 1, in which the stationary permanent magnet of the cap is made of a rare-earth permanent magnet.

14. The retractable pen as defined in claim 1, in which the stationary permanent magnet of the cap is exposed.

15. The retractable pen as defined in claim 1, in which the ink cartridge of the pen is a ball-point pen.

16. The retractable pen as defined in claim 1, in which the ink cartridge of the pen is a gel-ink pen.

* * * * *